US005575711A

United States Patent [19]

Hupp

[11] Patent Number: 5,575,711

[45] Date of Patent: Nov. 19, 1996

[54] WOOD JOINTER AND PLANER BLADE SHARPENING AND HONING HOLDER

[76] Inventor: Dale E. Hupp, 327 Manor Dr., Riverdale, Iowa 52722

[21] Appl. No.: 604,070

[22] Filed: Feb. 20, 1996

[51] Int. Cl.[6] ..... B24B 19/00

[52] U.S. Cl. ..... 451/367; 451/45; 451/378

[58] Field of Search ..... 451/185, 293, 451/367, 378, 45, 349, 555, 558, 557, 321; 269/87.2, 37, 246, 156, 277; 83/699.61, 699.51, 856, 858

[56] References Cited

U.S. PATENT DOCUMENTS

| | | | |
|---|---|---|---|
| 2,291,255 | 7/1942 | Powell | 451/380 |
| 2,302,937 | 11/1942 | Clark | 451/380 |
| 2,353,062 | 7/1944 | Olszewski | 451/380 |
| 2,481,936 | 9/1949 | Lord | 451/380 |
| 2,604,738 | 7/1952 | Ramey | 451/367 |
| 2,887,833 | 5/1959 | Passarotti | 451/367 |
| 2,990,729 | 7/1961 | Zernov et al. | 451/45 |
| 2,997,821 | 8/1961 | Dixon et al. | 451/380 |
| 3,011,366 | 12/1961 | Sandven et al. | 76/82 |
| 4,939,869 | 7/1990 | Stoll | 451/45 |
| 4,961,287 | 10/1990 | Compton | 451/193 |
| 5,271,442 | 12/1993 | Carpenter et al. | 144/220 |

*Primary Examiner*—D. S. Meislin
*Assistant Examiner*—Derris H. Banks

[57] ABSTRACT

This device is a low cost and an easy to use fixture for sharpening wood jointer and thickness planer blades or knives with extreme accuracy and sharpness. The device holds two blades at opposing angles creating a flat plane upon which a flat sharpening stone or abrasive device can employ repeated reciprocal movements. The holder is made of a rigid material with a bolt down clamp, which secures the two individual blades at the proper and precise angle. The design also employs individual adjustment screws, which elevates each end of both blades, allowing the user to sharpen blades of various widths. Once the rough sharpening is complete the device is then staged for the final honing of the blades. This feature makes it possible to sharpen the blades razor sharp as well as grind a secondary bevel on the blade.

2 Claims, 3 Drawing Sheets

WOOD JOINTER AND PLANER BLADE
SHARPENING AND HONING HOLDER

WOOD JOINTER AND PLANER BLADE
SHARPENING AND HONING HOLDER

WOOD JOINTER AND PLANER BLADE SHARPENING AND HONING HOLDER

BACKGROUND OF THE INVENTION

This invention is based on a simple fixture involving a blade holding device used together with a conventional sharpening stone or abrasive substance. The process produces an extremely accurate and razor sharp product. Presently, planer and jointer blades generally are sharpened outside the woodworking shop on large surface grinders or milling machines. For the home workshop woodworkers this method of sharpening blades is expensive, inconvenient and time consuming. There are devices available on the market which assist in sharpening planer and jointer blades. However, these devices sharpen one blade at a time and do not provide the accuracy as sometimes required. This invention allows the woodworker to sharpen His/Her planer and jointer blades right in the workshop. This process produces a sharpened flat surface, which is much stronger than a "hollow grind" surface which is produced by some commercial sharping services.

SUMMARY OF THE INVENTION

The present invention discloses a fixture or holder of sufficient length to secure two common planer or jointer blades in a position for sharpening and honing with a conventional abrasive device. This device may be a common sharpening stone, a water stone, a large diamond sharpener or an electric flat stone surface grinder. The holder is made of a very rigid and stable material, such as metal, plastic or a man made composite. The two blades are individually adjusted upward using a micrometer or two metal sleeves, one on each end, to position all four ends at an equal distance upward from the base of the fixture. This adjustment places the two blades parallel to each other and in the same plain. Since the adjustment screws act independent of each other, a considerably worn blade can be paired up with a new blade during the sharpening process. Once the blades are adjusted and securely clamped in place, the sharpening can begin. By placing the holder in a workbench vice the user can begin repeated reciprocal movements of a sharpening stone or device over the two surfaces created by the two opposing blades. By using a marking dye or a felt tip marker to color the flat surfaces of the two blades, the user will be able to determine when the rough grinding phase is complete. This same operation can be completed using an electric round surface grinder, which will accelerate the operation. If high speed abrasive equipment is used, care must be taken not to overheat the blades, since this can take the temper out of the blades. Once the rough grinding step is complete, which has produced the primary bevel on the blade, the next step is to hone the cutting edge of each blade. This step must be completed before the blades are removed or adjusted in any way. The process starts by placing a plastic spacer between one of the two blades and a very fine sharpening stone or device, while the sharpening device contacts the other blade. Again place a dye on the tip of the blade to be honed to assure that the blade has been honed completely from end to end. This process will only take a few strokes per blade. Once the first blade is complete place the spacer under the sharpening device of the completed blade and hone the second blade. A secondary bevel can be ground by simply stroking the blade longer. The blades are now complete and can be carefully removed from the holder. The user must be very cautious at removing the blades since they are razor sharp.

DESCRIPTION OF A PREFERRED EMBODIMENT

Figure 1:
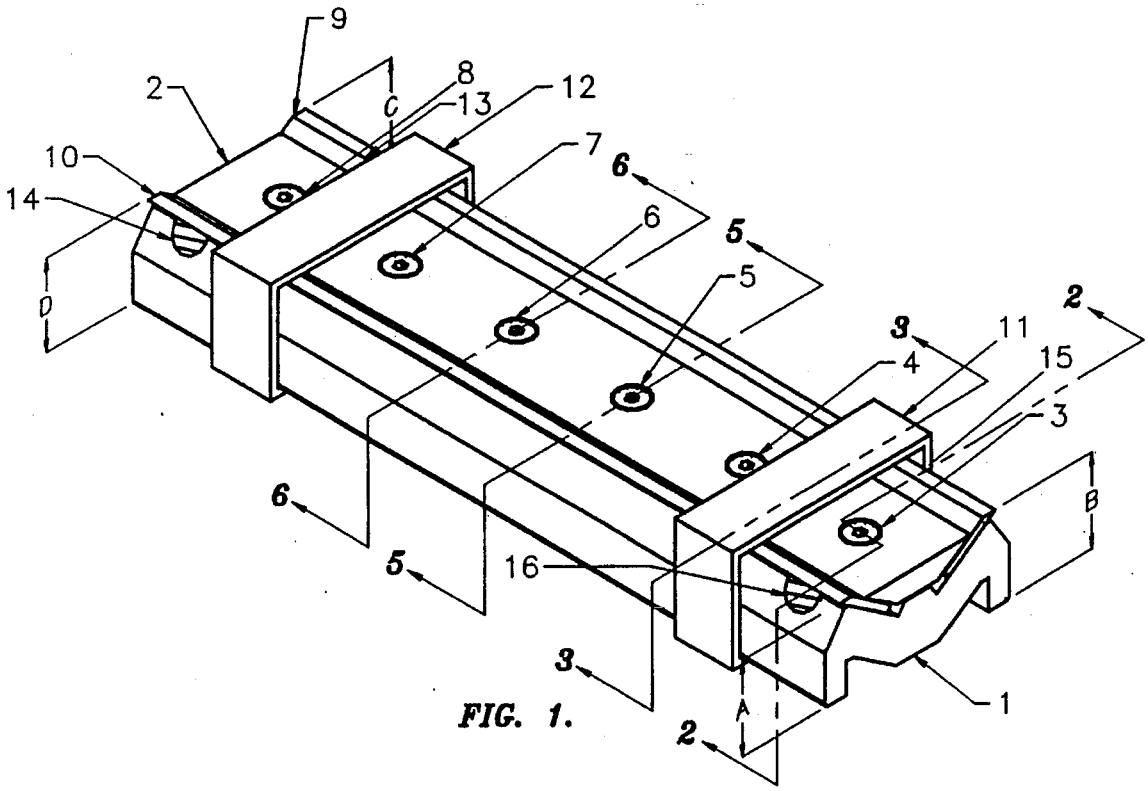
FIG. 1 is an isometric view of the wood jointer and planer blade sharpening and honing holder. With the two mounting sleeves, which are used to position the blades at the proper level, slid on each end.

Referring now to FIG. 1, there are two blades 9 & 10 mounted in the body 1 of the holder and lightly secured with the top clamp 2 and six fasteners 3,4,5,6,7 & 8 (the number of fasteners may vary). Distance A,B,C and D are made equal by adjusting the jack screws 13,14,15 & 16. This can be seen on FIG. 2 (which shows only one end). This adjustment is done by using two metal sleeves 11 & 12 one on each end, as can also be seen in FIG. 1. To set the two blades to the proper height, the adjustment is done by using the sleeves 11 & 12 (SEE FIG. 2 and 3), and adjusting the jack screws 13,14,15 & 16 upward until blades 9 & 10 contact the sleeves 11 & 12, but not so tight that the sleeves 11 & 12 can not be removed. Once the blades 9 & 10 are adjusted accurately, the two sleeves 11 & 12 can be removed and the clamp 2 can be tightened by tightening the fasteners 3,4,5,6,7 & 8. The sharpening process can now begin.

Figure 2:
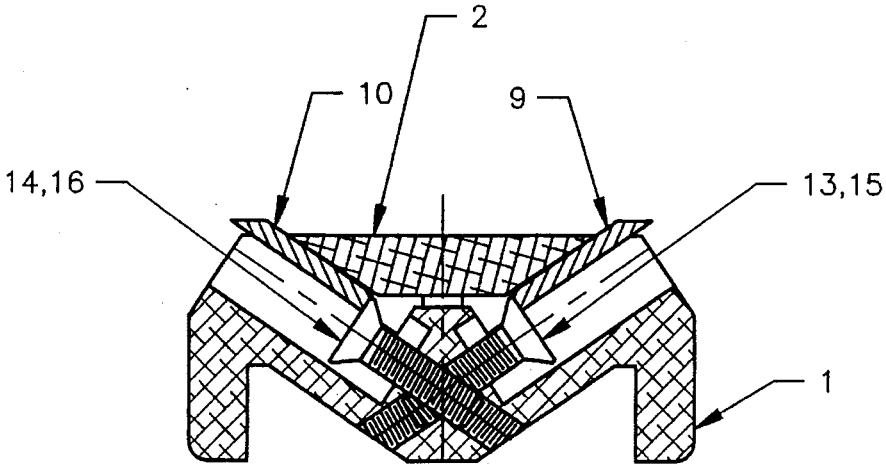
FIG. 2 is a section drawing "A—A" taken from FIG. 1, showing the holder body, top clamp and the ends of the two blades all relative to the blade adjustment feature.

FIG. 2 shows the relationship of two blades 9 & 10 to the four each jack screws 13, 14, 15 & 16 and how when turned, raises or lowers the blades 9 & 10.

Figure 3:
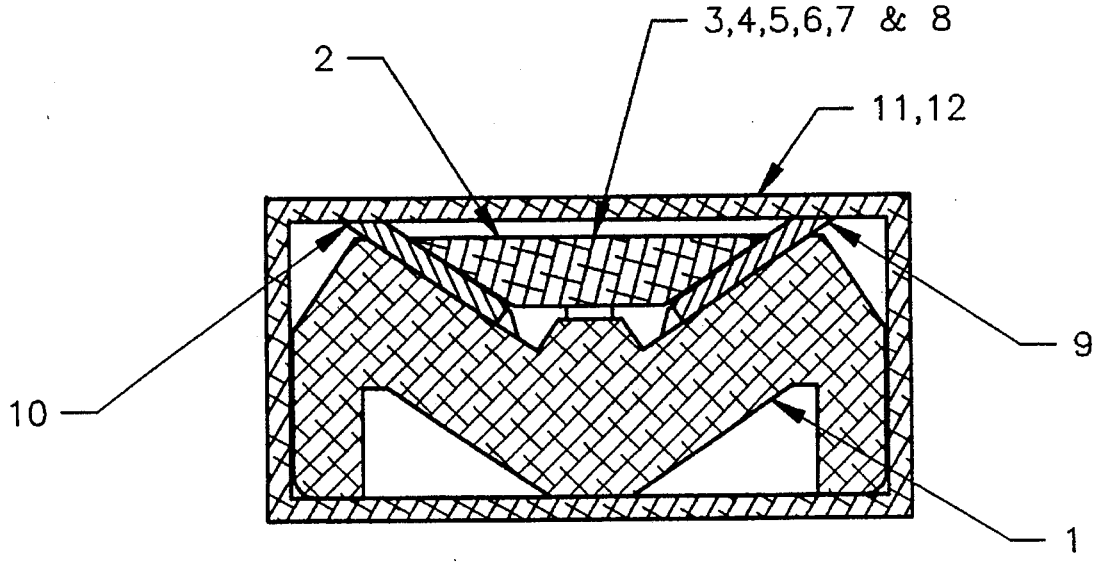
FIG. 3 is a section drawing "B—B" taken from FIG. 1, showing how the two blade mounting sleeves interfaces with the blades for the adjustment procedure.

FIG. 3 illustrates how the blades 9 & 10, when adjusted upward, contacts the sleeves 11 & 12.

Figure 4:
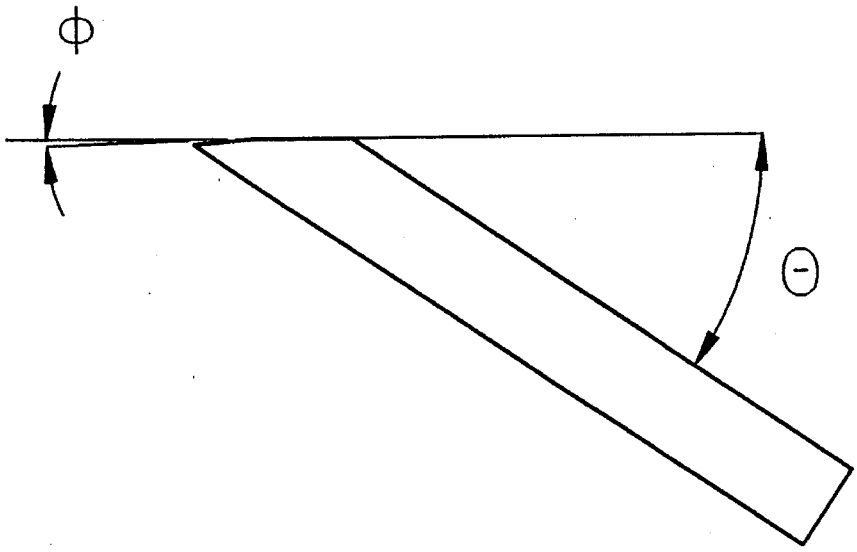
FIG. 4 is an enlarged end view of a jointer or planer blade showing the relationship of the primary and secondary bevels. Angle$\theta$ is the primary bevel and angle$\phi$ is the secondary bevel.

FIG. 4, an enlarged end view of the blade 9 or 10, points out relationship of the primary bevel or angle $\theta$ to the secondary bevel or angle$\phi$.

Figure 5:
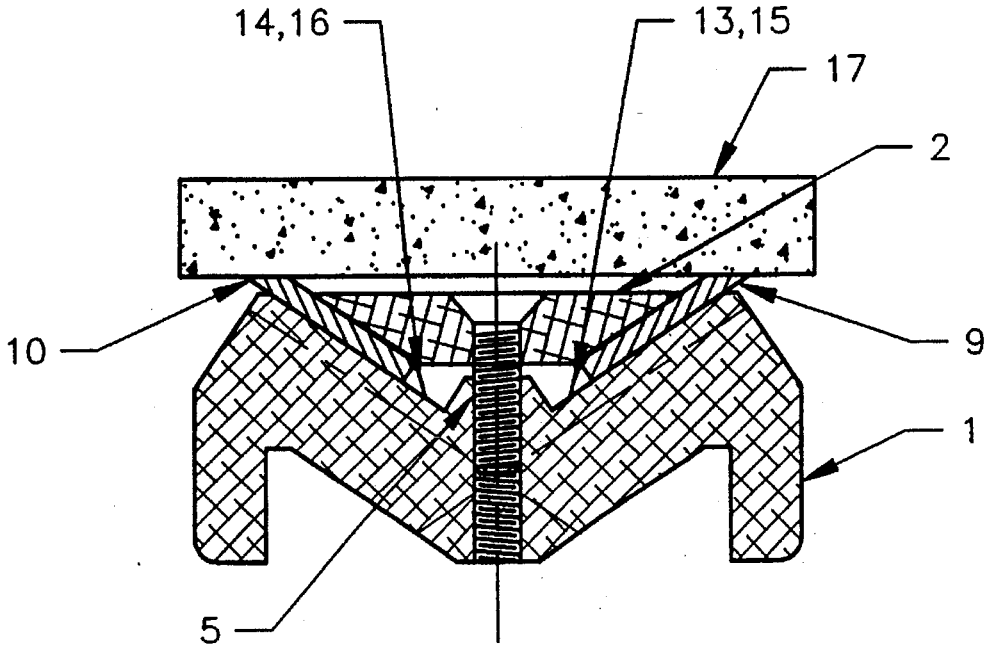
FIG. 5 is a section drawing "A—A" taken from FIG. 1, showing the holder body, top clamp, adjusting screws, the ends of the two blades (of different widths) all related to the rough sharpening stone or sharpening device.

FIG. 5 depicts how the sharpening stone or device 17 is positioned on the two blades 9 & 10. This operation will grind the primary bevel or angle described on FIG. 4. It works best to secure the holder in a workbench vice, freeing both hands to secure the sharpening device 17 and stroking the blades 9 & 10 with a repeated reciprocal movements. Once the tips of the blades 9 & 10 are ground to a sharp point, the rough grinding operation is complete.

Figure 6:
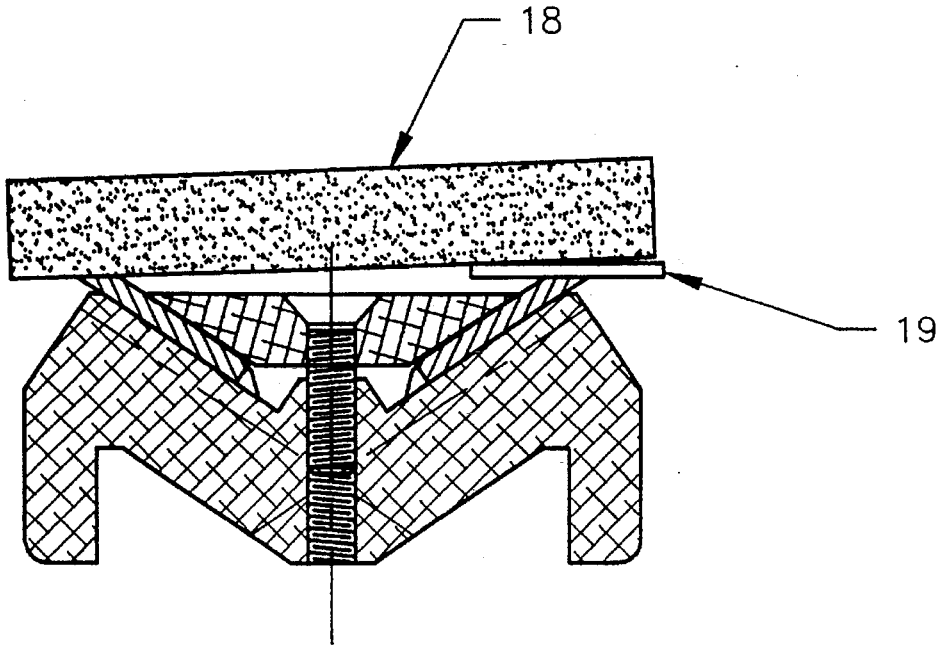
FIG. 6 is the same section drawing "A—A" only. this drawing depicts the honing phase, with the plastic spacer under the honing stone or honing device.

FIG. 6 is similar to FIG. 5 only it depicts the honing process. A secondary bevel or angle described on FIG. 4, can be ground into the blades with this same procedure by simply stroking the blades more. By placing a plastic spacer

19 between the very fine honing device 18 and the blade 9 the honing of blade 10 can begin. Using repeated reciprocal movements blade 10 will soon be complete. Once the process is complete the process is switched. The plastic spacer 19 is placed between blade 10 and the honing device 14 so that blade 9 can be honed. Once completed, the clamp 2 shown in FIG. 1 can be removed by removing fasteners 3,4,5,6,7 & 8 shown also in FIG. 1. This operation must be done very carefully, since the blades 9 & 10 are both razor sharp. Thus, from the foregoing it is seen that my holder will accomplish at least all of its stated objectives and the principle thereof can be used to sharpen jointer and planer blades. Some altercations may be made in the construction and arrangement of my blade sharpening and honing holder without departing from the original intent or purpose of my invention. It is my intention to cover by my claim, any modified form of the structure or use of mechanical equivalents which may be reasonably included within my scope.

Having thus described the invention, what I therefore, wish to claim is as follows:

1. A device for sharpening jointer and planer blades comprising:

(a) a integral elongated base of adequate length to fully clamp the complete length of two blades at opposing angles, (b) a top clamp to secure the two blades in the said base, and (c) blade jack screws tapped into the said base to adjust the height of each blade.

2. A device for sharpening jointer and planer blades as defined in claim 1 in which said blade jack screws adjust both blades independently to achieve parallelism between the blades thus resulting in one flat plane created by the beveled surfaces of the two blades.

* * * * *